US009701376B2

(12) United States Patent
Khachaturian

(10) Patent No.: US 9,701,376 B2
(45) Date of Patent: Jul. 11, 2017

(54) MARINE LIFTING APPARATUS

(71) Applicant: Jon Khachaturian, New Orleans, LA (US)

(72) Inventor: Jon Khachaturian, New Orleans, LA (US)

( * ) Notice: Subject to any disclaimer, the term of this patent is extended or adjusted under 35 U.S.C. 154(b) by 32 days.

(21) Appl. No.: 14/629,696

(22) Filed: Feb. 24, 2015

(65) Prior Publication Data

US 2015/0259054 A1 Sep. 17, 2015

Related U.S. Application Data

(63) Continuation of application No. 13/308,172, filed on Nov. 30, 2011, now Pat. No. 8,960,114.
(Continued)

(51) Int. Cl.
*B63B 27/16* (2006.01)
*B63C 7/00* (2006.01)
(Continued)

(52) U.S. Cl.
CPC ..... *B63C 7/20* (2013.01); *B63B 1/121* (2013.01); *B63B 27/16* (2013.01); *B63B 27/36* (2013.01);
(Continued)

(58) Field of Classification Search
CPC ... B63B 27/16; B63B 2027/165; B63B 27/36; B63B 2738/00; B63B 2738/12;
(Continued)

(56) References Cited

U.S. PATENT DOCUMENTS 2,378 A 12/1841 Custis
77,501 A * 5/1868 Martin ..... B63C 7/04 114/51
(Continued)

*Primary Examiner* — Ajay Vasudeva
(74) *Attorney, Agent, or Firm* — Garvey, Smith & Nehrbass Patent Attorneys, L.L.C.; Charles C. Garvey, Jr.; Vanessa M. D'Souza

(57) ABSTRACT

A catamaran lifting apparatus is disclosed for lifting objects in a marine environment. The apparatus includes first and second vessels that are spaced apart during use. A first frame spans between the vessels. A second frame spans between the vessels. The frames are spaced apart and connected to the vessels in a configuration that spaces the vessels apart. The first frame connects to the first vessel with a universal joint and to the second vessel with a hinged connection. The second frame connects to the second vessel with a universal joint and to the first vessel with a hinged or pinned connection. The catamaran hull arrangement provides longitudinal flexibility in a quartering sea state due to the unique universal joint and hinge placement between the frames or trusses and the hulls or barges. Each of the frames extends upwardly in an inverted u-shape, providing a space under the frame and in between the barges that enables a marine vessel to be positioned in between the barges and under the frames. In this fashion, an object that has been salvaged from the seabed can be placed upon the marine vessel that is positioned in between the barges and under the frames. Alternatively, a package that is to be lifted from the deck of a marine vessel, workboat, supply boat or the like can be lifted from the deck of the workboat, vessel, barge, etc. if it is to be then placed in the marine environment such as upon an existing jacket or other under support.

31 Claims, 14 Drawing Sheets

Related U.S. Application Data

(60) Provisional application No. 61/418,198, filed on Nov. 30, 2010.

(51) Int. Cl.
*B63C 7/20* (2006.01)
*B63B 27/36* (2006.01)
*B63B 1/12* (2006.01)

(52) U.S. Cl.
CPC ... *B63B 2001/123* (2013.01); *B63B 2027/165* (2013.01)

(58) Field of Classification Search
CPC .... B63C 7/00; B63C 7/02; B63C 7/04; B63C 7/16; B63C 7/18; B63C 7/20; B63C 7/24; B63C 2205/08; B63C 2702/02; B63C 3/06; B63C 11/50; E02B 17/02; E02B 17/021; E02B 2017/0047
USPC ..... 114/44, 50, 51; 405/203, 204, 209; 294/66.1, 66.2
See application file for complete search history.

(56) References Cited

U.S. PATENT DOCUMENTS

| | | | | |
|---|---|---|---|---|
| 485,398 | A | 11/1892 | Tyler et al. | |
| 1,135,338 | A | 4/1915 | Vecsey | |
| 1,630,994 | A | 5/1927 | Wicks | |
| 1,710,103 | A | 4/1929 | Nelson | |
| 1,767,672 | A * | 6/1930 | Hills | B63C 7/20 114/53 |
| 1,854,026 | A * | 4/1932 | Gamba | B63C 7/08 114/53 |
| 1,998,607 | A | 4/1935 | Byler | |
| 2,232,564 | A | 2/1941 | Schwarz et al. | |
| 2,329,972 | A * | 9/1943 | Zoll | B63C 7/04 114/51 |
| 3,807,336 | A * | 4/1974 | Briggs | B63C 7/02 114/51 |
| 4,385,583 | A | 5/1983 | Ayers | |
| 4,714,382 | A | 12/1987 | Khachaturian | |
| 5,054,415 | A | 10/1991 | Marshall | |
| 5,607,260 | A | 3/1997 | Khachaturian | |
| 5,609,441 | A | 3/1997 | Khachaturian | |
| 5,662,434 | A | 9/1997 | Khachaturian | |
| 5,800,093 | A | 9/1998 | Khachaturian | |
| 5,975,807 | A | 11/1999 | Khachaturian | |
| 6,039,506 | A | 3/2000 | Khachaturian | |
| 6,149,350 | A | 11/2000 | Khachaturian | |
| 6,318,931 | B1 | 11/2001 | Khachaturian | |
| 6,364,574 | B1 | 4/2002 | Khachaturian | |
| 6,367,399 | B1 | 4/2002 | Khachaturian | |
| 7,527,006 | B2 | 5/2009 | Khachaturian | |
| 7,845,296 | B1 | 12/2010 | Khachaturian | |
| 7,886,676 | B2 | 2/2011 | Khachaturian | |
| 8,061,289 | B2 | 11/2011 | Khachaturian | |
| 8,960,114 | B2 | 2/2015 | Khachaturian | |
| 2002/0135192 | A1 | 9/2002 | Alexander, III et al. | |
| 2007/0231076 | A1 * | 10/2007 | Khachaturian | B63C 3/06 405/204 |
| 2010/0229777 | A1 | 9/2010 | Khachaturian | |

* cited by examiner

MARINE LIFTING APPARATUS

CROSS-REFERENCE TO RELATED APPLICATIONS

This is a continuation of U.S. patent application Ser. No. 13/308,172, filed 30 Nov. 2011 (issued as U.S. Pat. No. 8,960,114 on 24 Feb. 2015), which is a non provisional patent application of and claims benefit of U.S. Provisional Patent Application Ser. No. 61/418,198, filed 30 Nov. 2010, which is incorporated herein by reference. Priority of these applications is hereby claimed.

Priority of U.S. Provisional Patent Application Ser. No. 61/418,198, filed 30 Nov. 2010, which is incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to marine lifting devices. More particularly, the present invention relates to a lifting apparatus for use in a marine environment, wherein a specially configured dual jaw or claw lifting device enables lifting of submerged objects such as items to be salvaged from a sea bed.

2. General Background

A lifting apparatus can be used to lift multi-ton objects. Derrick barges have been used to lift multi-ton packages in a marine environment. In general, lifting devices that employ a pair of spaced apart hulls have been patented, many patents having been issued to applicant as contained in the following table.

TABLE 1

| PAT. NO. | TITLE | ISSUE DATE MM-DD-YYYY |
|---|---|---|
| 4,714,382 | Method and Apparatus for the Offshore Installation of Multi-Ton Prefabricated Deck Packages on Partially Submerged Offshore Jacket Foundations | 12-22-1987 |
| 5,607,260 | Method and Apparatus for the Offshore Installation of Multi-Ton Prefabricated Deck Packages on Partially Submerged Offshore Jacket Foundations | 03-04-1997 |
| 5,609,441 | Method and Apparatus for the Offshore Installation of Multi-Ton Prefabricated Deck Packages on Partially Submerged Offshore Jacket Foundations | 03-11-1997 |
| 5,662,434 | Method and Apparatus for the Offshore Installation of Multi-Ton Prefabricated Deck Packages on Partially Submerged Offshore Jacket Foundations | 09-02-1997 |
| 5,800,093 | Method and Apparatus for the Offshore Installation of Multi-Ton Packages Such as Deck Packages, Jackets, and Sunken Vessels | 09-01-1998 |
| 5,975,807 | Method and Apparatus for the Offshore Installation of Multi-Ton Packages Such as Deck Packages and Jackets | 11-02-1999 |

TABLE 1-continued

| PAT. NO. | TITLE | ISSUE DATE MM-DD-YYYY |
|---|---|---|
| 6,039,506 | Method and Apparatus for the Offshore Installation of Multi-Ton Packages Such as Deck Packages and Jackets | 03-21-2000 |
| 6,149,350 | Method and Apparatus for the Offshore Installation of Multi-Ton Packages Such as Deck Packages and Jackets | 11-21-2000 |
| 6,318,931 | Method and Apparatus for the Offshore Installation of Multi-Ton Packages Such as Deck Packages and Jackets | 11-20-2001 |
| 6,364,574 | Method and Apparatus for the Offshore Installation of Multi-Ton Packages Such as Deck Packages and Jackets | 04-02-2002 |
| 7,527,006 | Marine lifting apparatus | 05-05-2009 |
| 7,845,296 | Marine lifting apparatus | 12-07-2010 |
| 7,886,676 | Marine lifting apparatus | 02-15-2011 |

BRIEF SUMMARY OF THE INVENTION

The present invention provides an improved marine lifting apparatus that can employ first and second spaced apart vessels or hulls. The vessels can be barges, dynamically positioned marine vessels, other floating hulls or the like.

In one embodiment, the lifting apparatus can employ a first frame or truss spans between the vessels or hulls at a first position and a second frame or truss spans between the hulls at a second position.

In one embodiment, the first and second positions are spaced apart so that each frame can move independently of the other, notwithstanding wave action acting upon the hulls.

In one embodiment, load spreaders can provide an interface between each frame or truss and each vessel (e.g., barge, ship, etc.).

In one embodiment, the first of the frames or trusses connects to the first hull or vessel with a universal joint and to the second hull or vessel with a hinged connection.

The second frame connects to the second hull with a universal joint and to the first hull with a hinged connection.

In one embodiment, the catamaran hull arrangement of the present invention provides longitudinal flexibility in a quartering sea state due to the unique universal joint and hinge placement between the frames or trusses and the hulls or vessels.

In one embodiment, each frame extends upwardly in a generally inverted u-shape that provides space under each frame or truss and in between the vessels or hulls for enabling a marine vessel to be positioned in between the hulls and under the frames. The space in between the hulls or vessels and under the frames or trusses can also be used as clearance for elevating an object to be salvaged from the seabed to a position next to or above the water's surface.

In one embodiment, in a plan view each frame or truss can be generally triangular in shape.

In one embodiment, winches and rigging such as a block and tackle arrangement can be used to lift objects.

In one embodiment, frames can be of a truss configuration.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
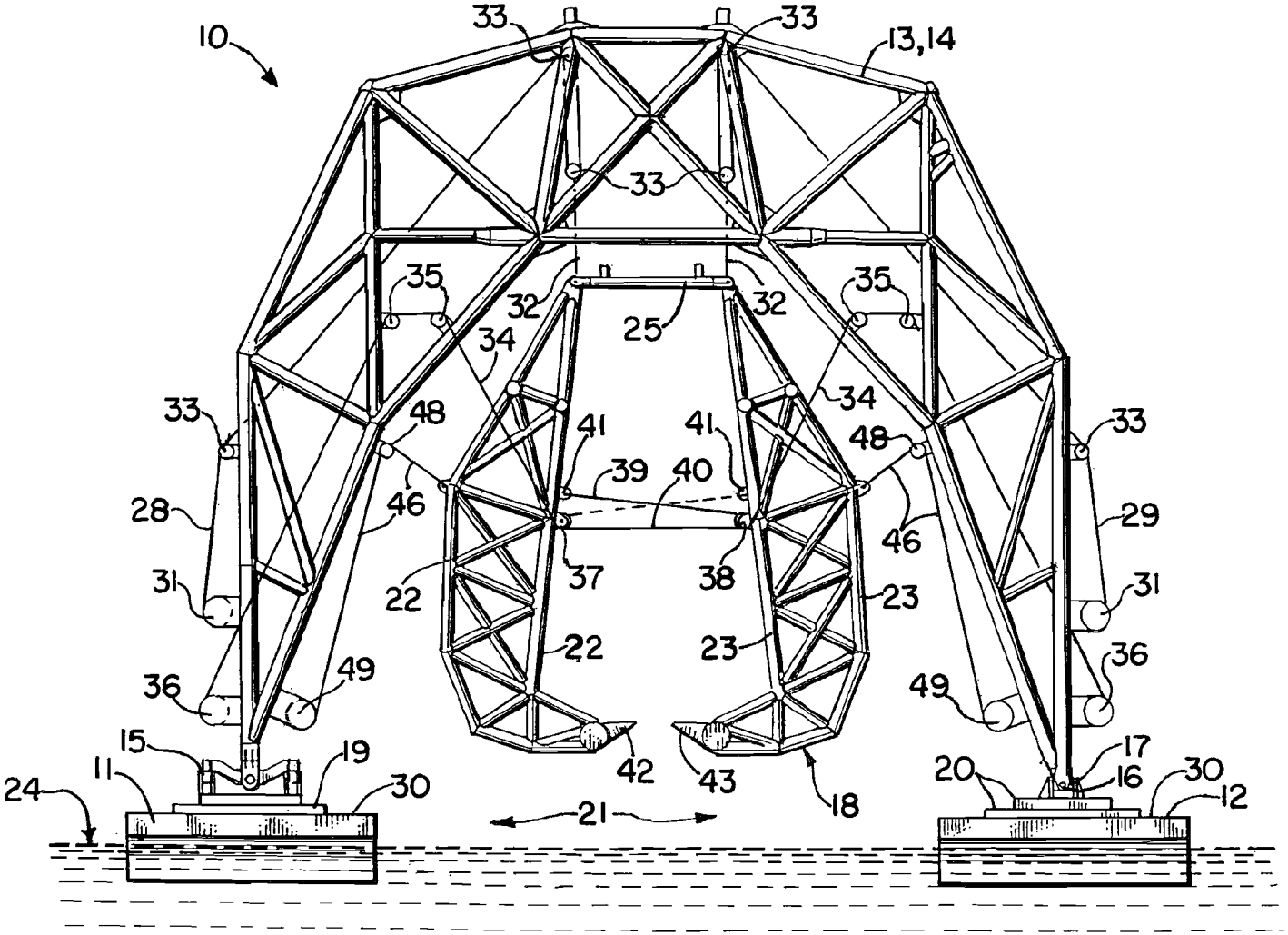
FIG. 1 is an elevation view of a preferred embodiment of the apparatus of the present invention.

FIGS. 1-9 show a preferred embodiment of the apparatus of the present invention designated generally by the numeral 10. Marine lifting apparatus 10 provides a pair of spaced apart vessels or hulls 11, 12, each providing a deck 30. Hulls 11, 12 can be barges, dynamically positioned vessels, or any other buoyant structures. A pair of frames or trusses 13, 14 are provided, each frame 13, 14 spanning between the vessels 11, 12. Each frame 13, 14 connects to one vessel 11 or 12 with a universal joint 15 or 17 and to the other hull 11 or 12 with a hinged or pinned connection 16. Such a lifting arrangement with a pair of vessels, a pair of spaced apart frames and connections that include universal joints and hinged or pivotal connections can be seen in my prior U.S. Pat. Nos. 7,527,006, 7,845,296, and 7,886,676 each said patent hereby incorporated herein by reference.

The first frame 13 connects to hull 11 with universal joint 15 (or articulating connection). The first frame 13 connects to vessel 12 with a pinned connection or hinge 16. Similarly, the second frame 14 connects to hull 12 with a universal joint 17 (or articulating connection) and to hull 11 with a hinge or pinned connection 16.

An interface such as a deck beam or load spreader platform can be provided on the upper deck 30 of each hull 11, 12 for forming an interface between the frames 13, 14 and the vessels 11, 12. For example, vessel 11 is provided with deck beam or load spreader platform 19 on its deck 30 that forms an interface between each of the frames 13, 14 and the barge or vessel 11 deck 30. Deck beam or load spreader platform 20 provides an interface between each of the frames 13, 14 and deck 30 of the vessel or barge 12.

In FIG. 1, a lifting area 21 is that area that is in between the vessels 11, 12. This area 21 is sized and shaped to receive a vessel 47 having a cargo to be lifted if that cargo (e.g., deck package) is to be installed. Alternatively, the area 21 can be an area that receives a vessel 47 for supporting and transporting an item to be salvaged from an ocean floor (see FIGS. 8 and 9) such as a hurricane smashed or damaged offshore platform section, sunken boat or other package 44. In either case, a clearance is provided above the water surface 24.

Each of the frames 13, 14 can be in the form of a truss as shown. The frames are generally speaking in the shape of an arch or inverted U so that an area 21 is provided under the frames 13, 14 and above the water surface 24 for raising a package 44 that is being salvaged from seabed 45 (see FIGS. 3-7).

FIGS. 1-9 show a grab or lifting implement 18 that can be used to lift a package 44 that is to be salvaged from a seabed 45. FIGS. 10-16 show a second embodiment of lifting implement 50 wherein a truss or frame 51 supports jaw sections 52, 53 (see FIGS. 13-14). The grab or lifting implement 18 includes two trussed sections 22, 23. Each of the truss sections 22, 23 is pivotally attached to beam 25. Each truss section 22, 23 attaches to beam 25 at a pivot, pivotal connection, or pinned connection 26 or 27. Truss section 22 attaches to beam 25 at pivot or pinned connection 26. Similarly, truss section 23 attaches to beam 25 at pivot or pinned connection 27. The pivot or pinned connection 26, 27 are provided on opposed end portions of beam 25. (See FIGS. 1-2.)

In order to lift or lower the grab or lifting implement 18, a plurality of lift lines 28, 29 are provided. These lift lines 28, 29 can be attached to sheaves 33 or other suitable rigging and then wound upon powered winches 31. Some of the sheaves 33 are rigged with lift lines 32 that support the jaws 22, 23 (see FIG. 1).

Figure 2:
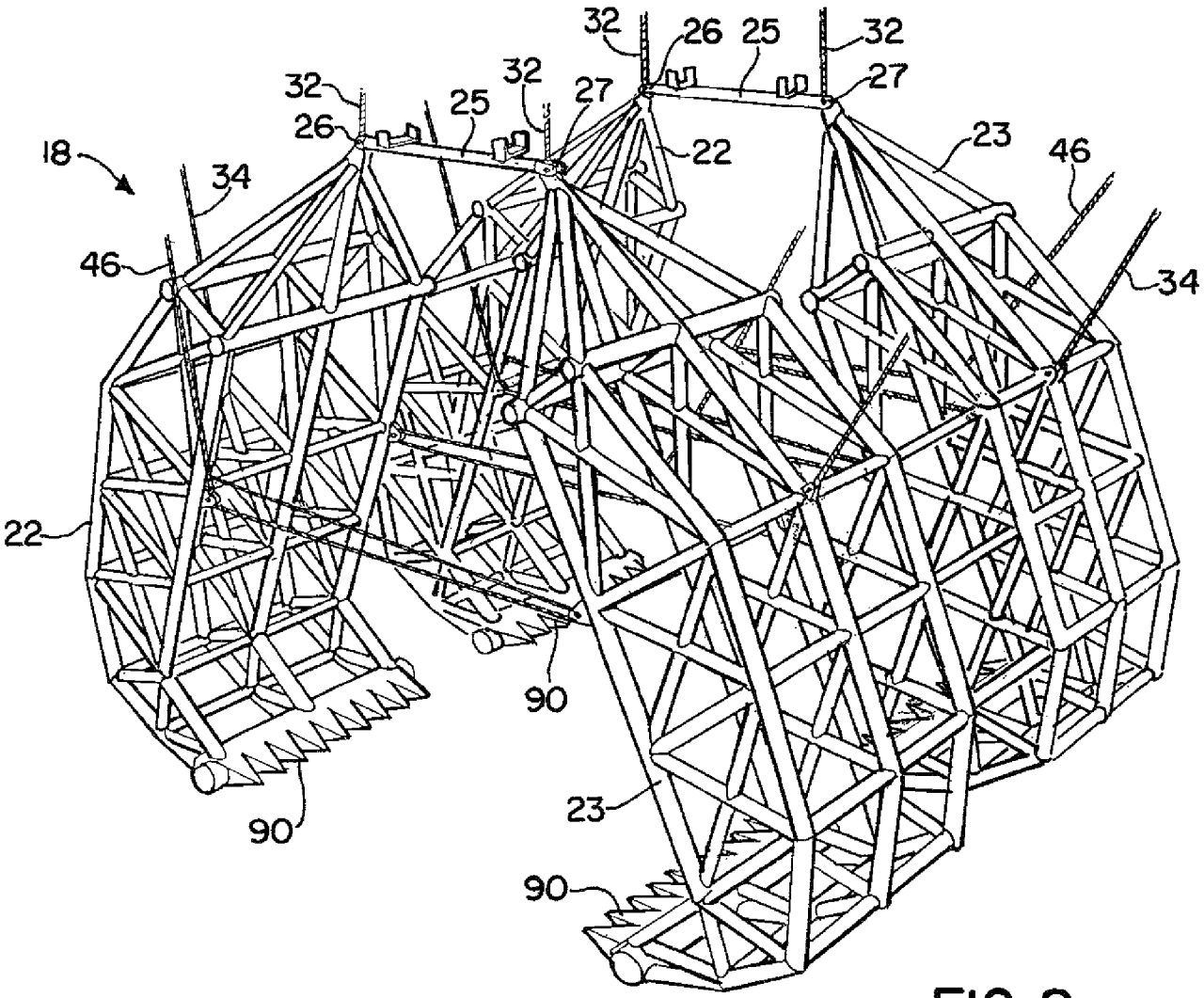
FIG. 2 is a perspective view of a preferred embodiment of the apparatus of the present invention.
Figure 3:
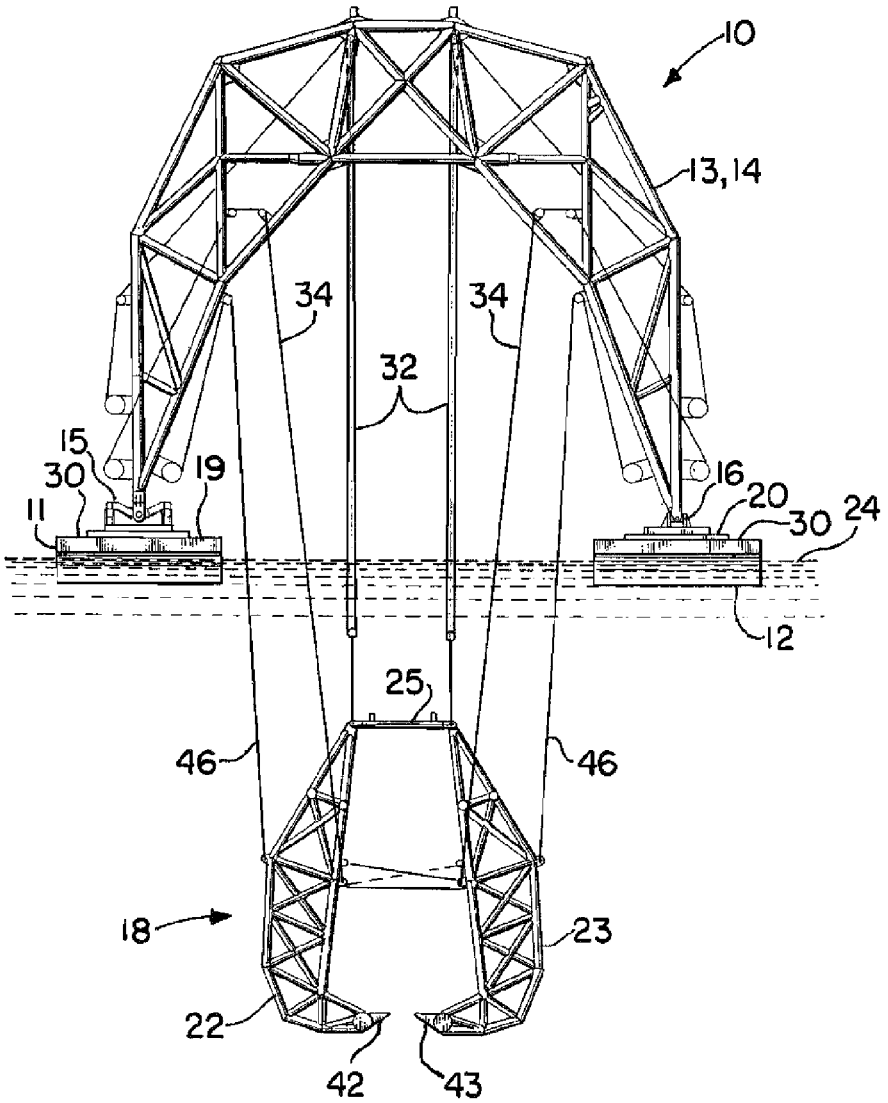
FIG. 3 is an elevation view of a preferred embodiment of the apparatus of the present invention showing a package to be salvaged from a seabed.
Figure 3:
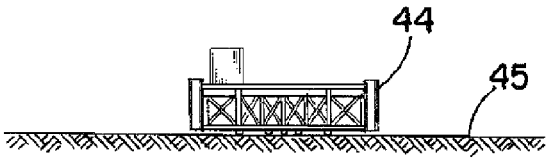
Figure 4:
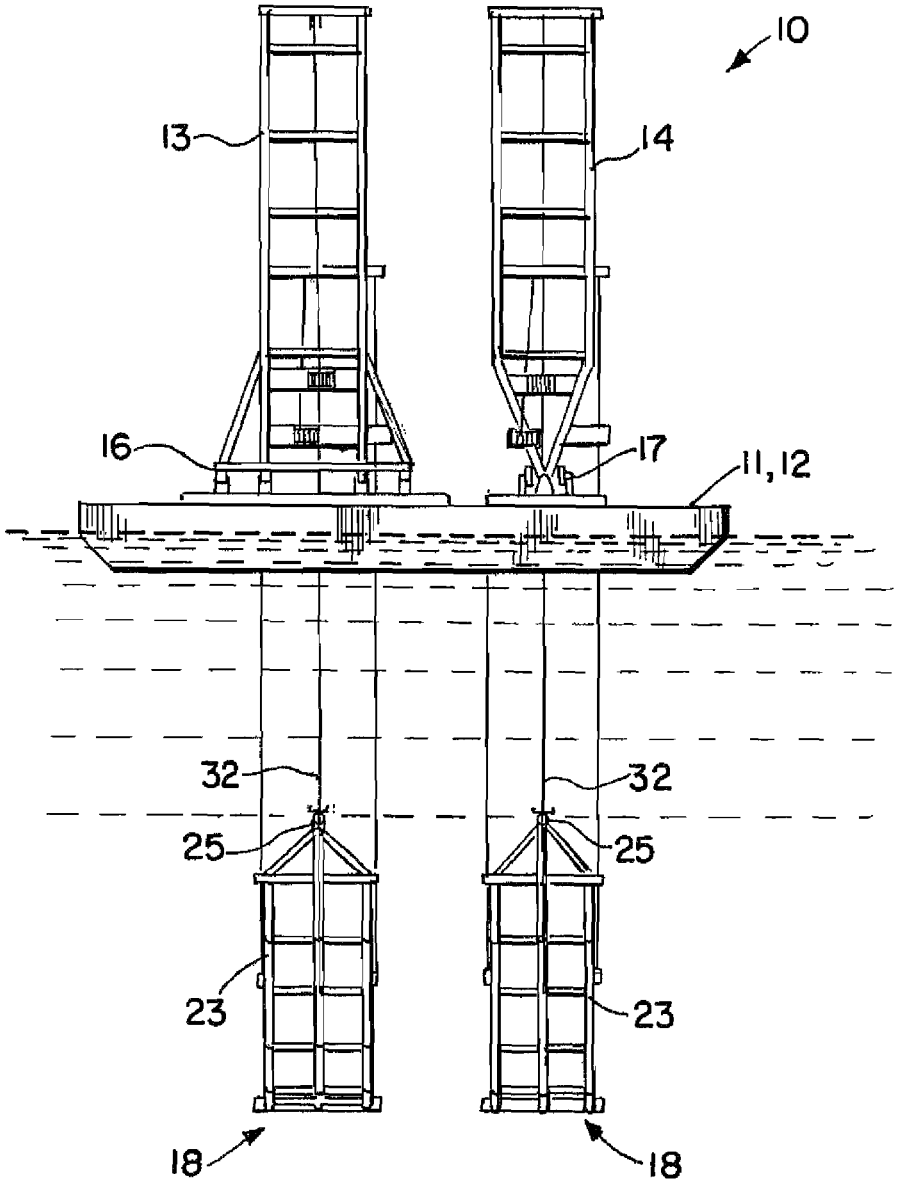
FIG. 4 is a side view of a preferred embodiment of the apparatus of the present invention.
Figure 4:
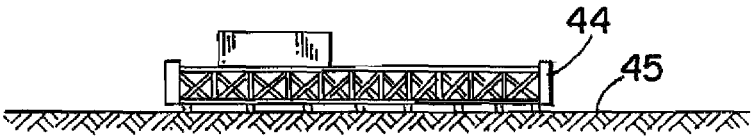
Figure 5:
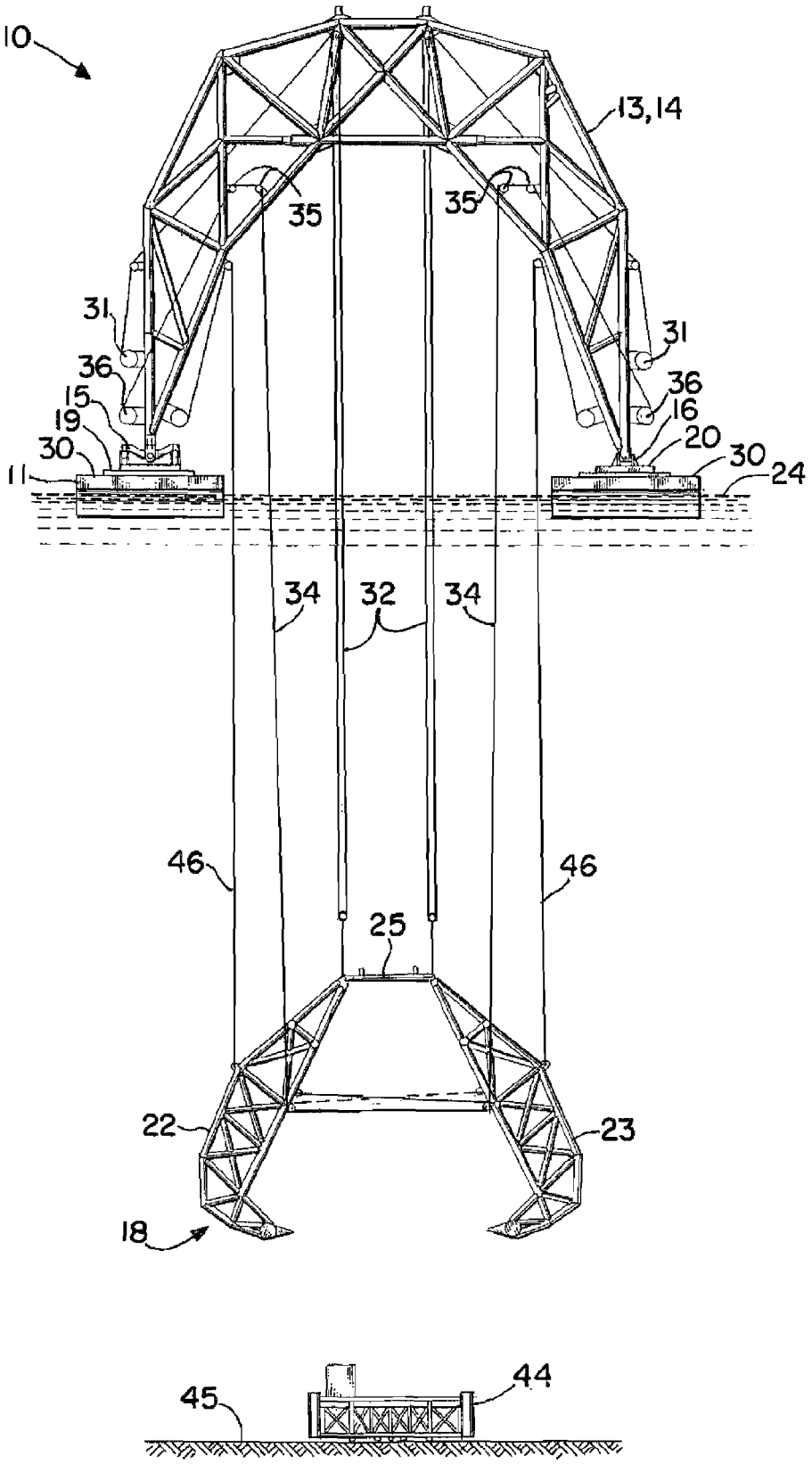
FIG. 5 is an elevation view of a preferred embodiment of the apparatus of the present invention showing a package to be salvaged from a seabed and a lowering of the grab or lifting implement.

In order to open the grab or lifting implement 18, lift lines 46 are provided. A closed position of the truss sections 22, 23 can be seen in FIGS. 1 and 3. An open position of the grab or lifting implement 18 can be seen in FIGS. 2 and 5. In FIGS. 2 and 5, the lift lines 46 are in tension. The lift lines 46 can be powered by winches 49 and rigged appropriately to the frames 13, 14 using sheaves 48 or other rigging as needed (see FIG. 1).

In order to close the grab or lifting implement 18, lift lines 46 are provided. The lift lines 34 extend from appropriate rigging on the frames 13, 14 such as sheaves 35 and winches 36 to spaced apart sheaves 37, 38 as seen in FIG. 1. Transverse lines 39, 40 extend between the sheaves 37, 38 and to a padeye 41 as seen in FIG. 1. In this fashion when tension is applied to the lift lines 34, tension is also applied to the transverse lines 39, 40 for pulling the truss sections 22, 23 together as shown in FIG. 1. When the truss sections 22, 23 are pulled together, they each pivot relative to beam 25.

Each truss section 22, 23 is provided with a generally laterally extending tapered section or blade 42, 43.

Truss section 22 is provided with a tapered section or blade 42. Truss section 23 is provided with tapered section or blade 43. Each tapered section or blade 42, 43 can be provided with teeth 90 (see FIG. 2).

FIGS. 3-9 illustrate the method of the present invention. In FIG. 1, vessels 11, 12 with spaced apart frames 13, 14 support grab or lifting implement 18 above a water surface 24. In FIG. 1, lines 32 suspend grab 18 below frames 13, 14 as shown. In FIGS. 3-9, the numeral 44 represents a package to be lifted from an underwater location such as a seabed 45.

The present invention enables such a package 44 to be lifted with minimal or no assistance from human divers. In the prior art, divers are typically required to place rigging on package 44 or to otherwise facilitate the lift. This activity places divers in possibly dangerous situations as the package can be in deep water at times where visibility can be poor.

Figure 6:
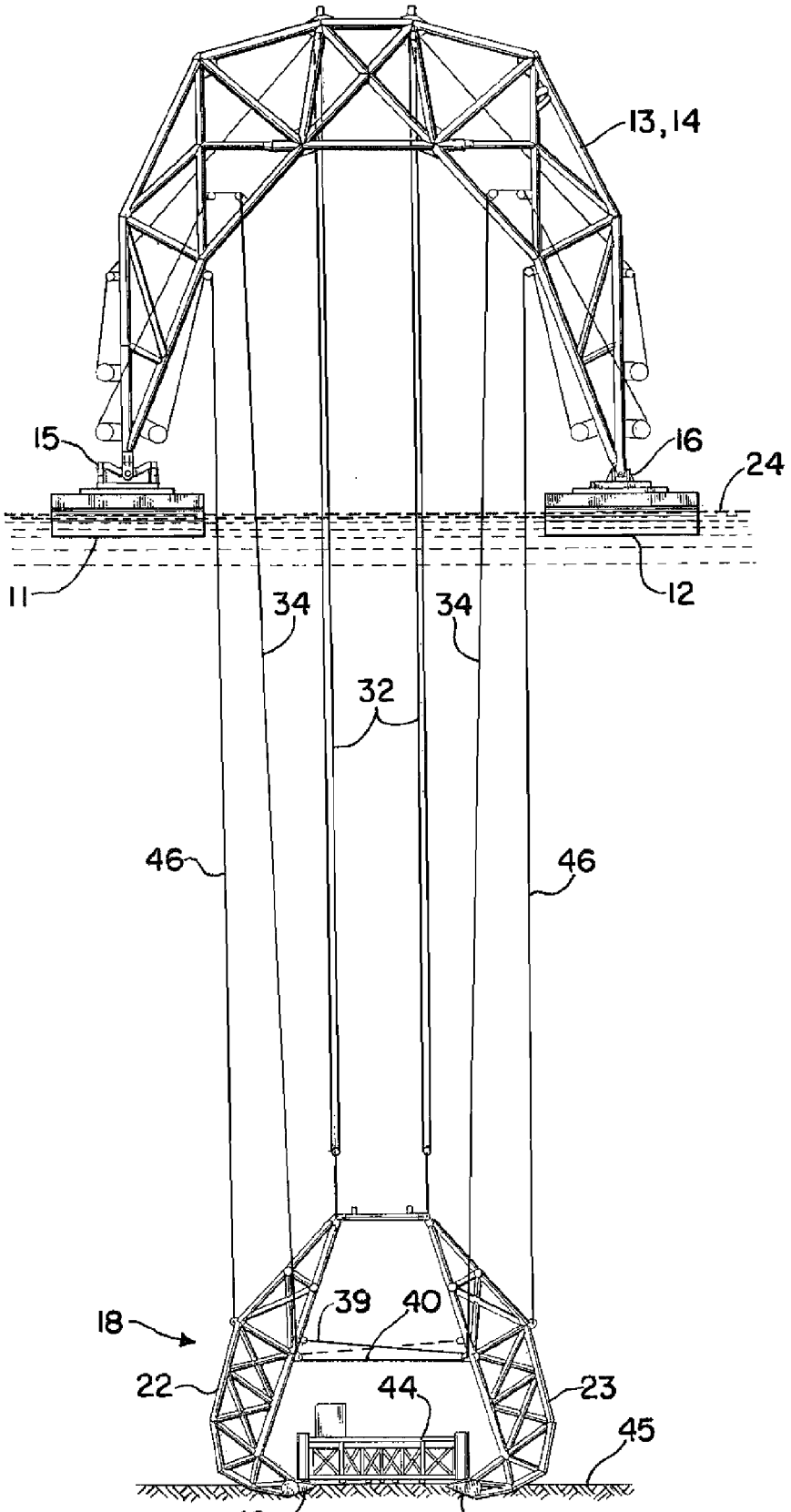
FIG. 6 is an elevation view of a preferred embodiment of the apparatus of the present invention showing the package to be salvaged and the grab or lifting implement as it forms a connection with the package to be lifted.
Figure 7:
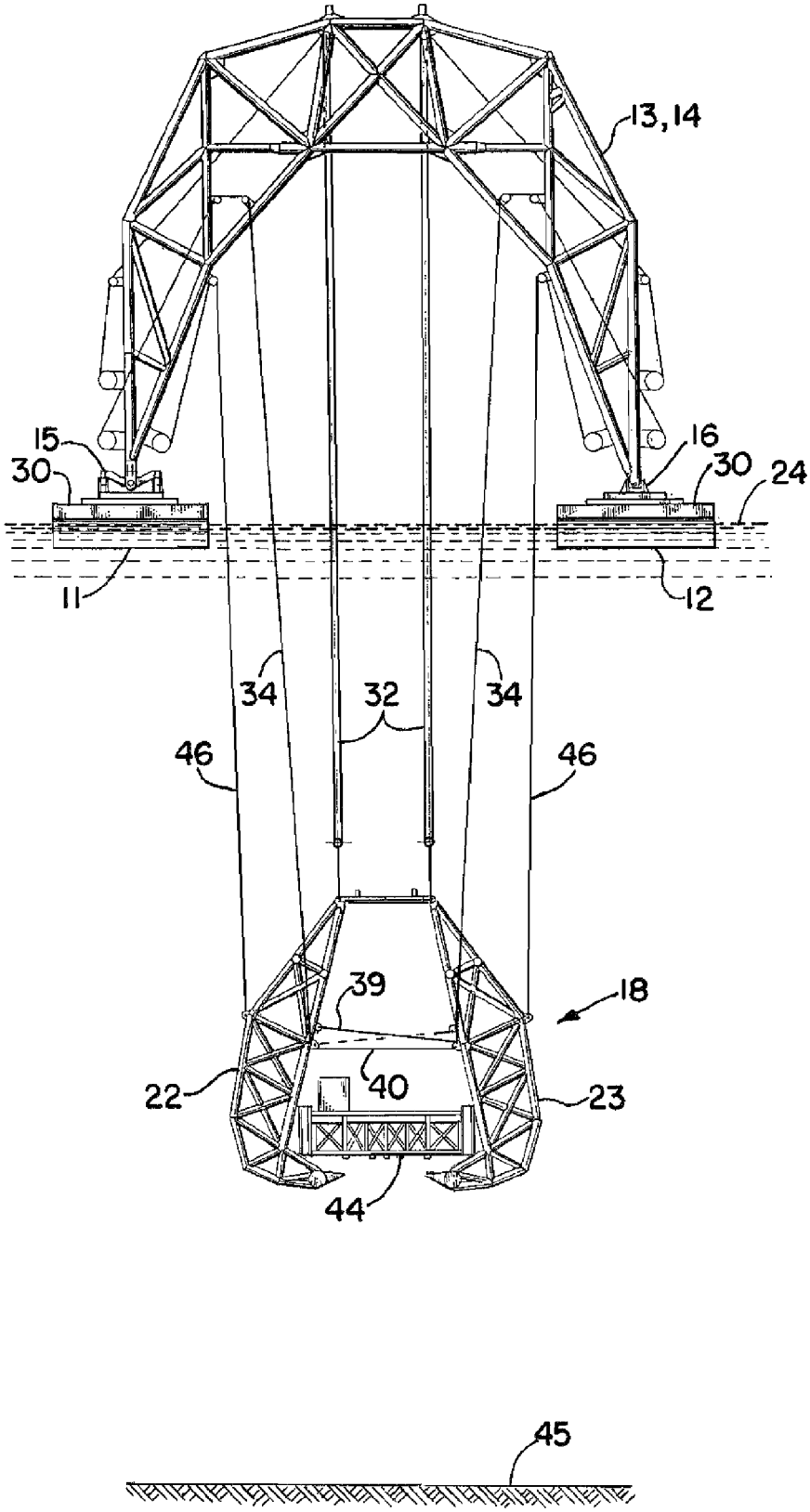
FIG. 7 is an elevation view of a preferred embodiment of the apparatus of the present invention showing the package to be salvaged after it has been lifted from the seabed with the lifting implement.
Figure 8:
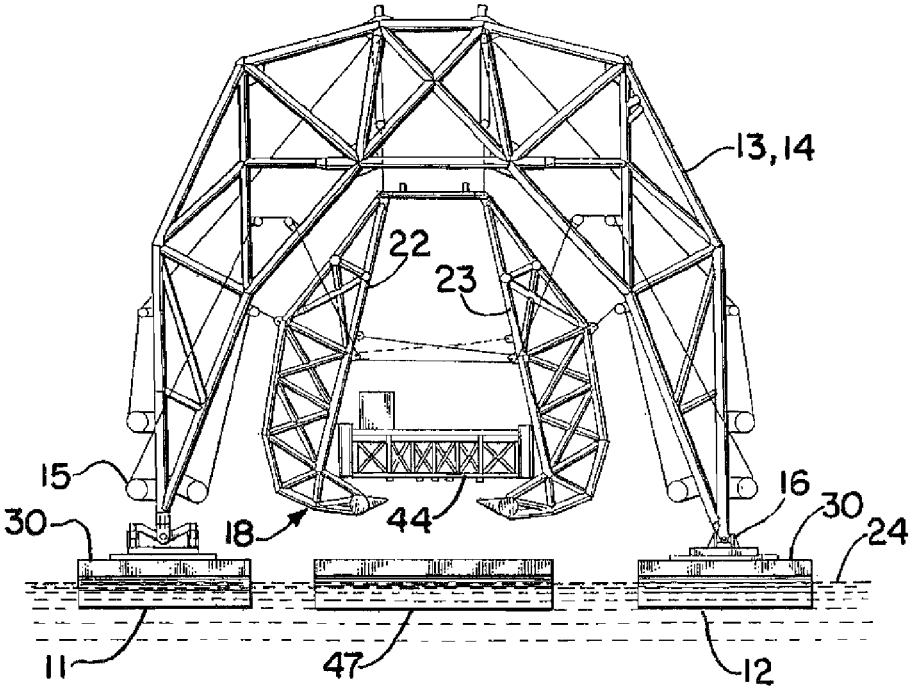
FIG. 8 is an elevation view of a preferred embodiment of the apparatus of the present invention showing the package to be salvaged after it has been lifted above the water surface.
Figure 8:
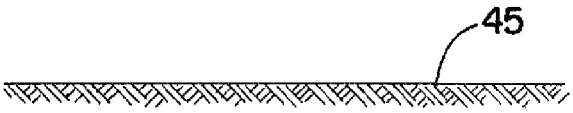
Figure 9:
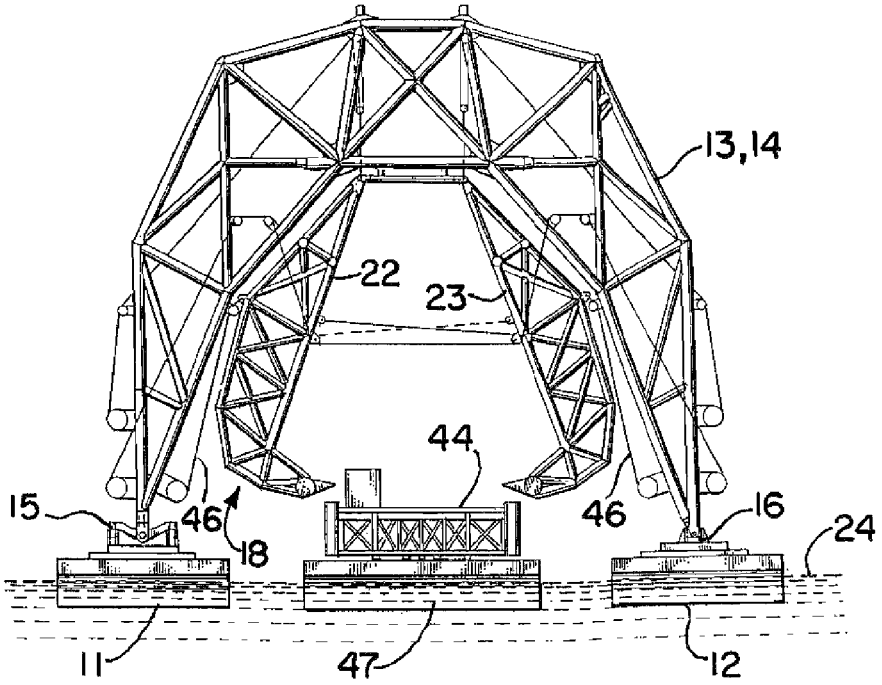
FIG. 9 is an elevation view of a preferred embodiment of the apparatus of the present invention showing the package after it has been deposited on a transport vessel or a barge.
Figure 9:
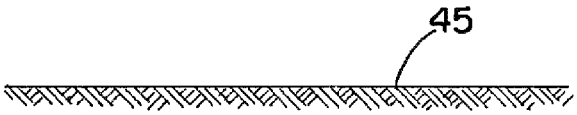

With the method of the present invention, the lift or grab 18 is lowered to the seabed 45 (see FIGS. 3-6). The truss sections 22, 23 are moved to the open position of FIG. 5 so that the tapered sections or blades 42, 43 are placed on opposing sides of and below or at the bottom of package 44 as shown in FIG. 6. If the seabed 45 is mud or other soft material, tapered sections or blades 42, 43 can sink below the mud line and below the bottom of package 44. In FIG. 5, lines 32 are in tension supporting grab 18. Lines 46 are in tension to hold the grab 18 truss sections 22, 23 in the open position. In FIGS. 6-7, lines 32, 46 are slack, not in tension for enabling a closing of truss sections 22, 23. Tapered sections or blades 42, 43 move toward each other an under package 44 in FIGS. 6-7.

After the truss sections 22, 23 and the tapered portions or blades 42, 43 are placed under the package 44, the package 44 can be lifted by maintaining lines 32, 34 and 39, 40 in tension while lifting the grab 18 using lift lines 32. Once lifted, the combination of the grab 18 and the package 44 will be lifted above the water's surface 24 to the position shown in FIG. 8. In this elevated position above the water's surface, a transport vessel 47 can be moved under the package 44 (see FIG. 8). The lines 32 can then be used to lower the grab 18 and package 44 to the barge or vessel 47. The lines or cables 46 are then used to open the grab 18, moving the truss sections 22, 23 apart to the position shown in FIG. 9.

Figure 13:
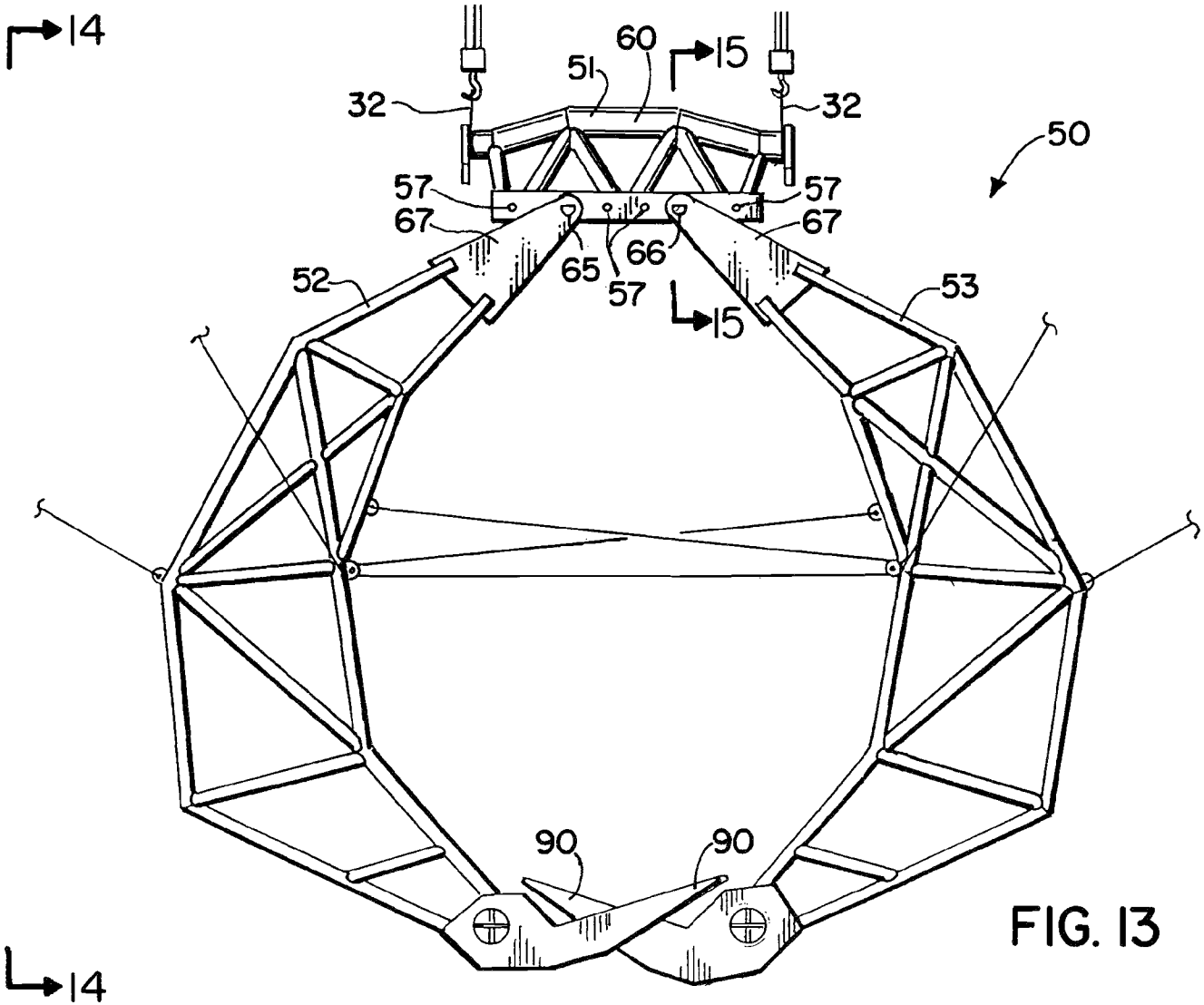
FIG. 13 is a partial elevation view of an alternate arrangement for a lifting implement or grab of the apparatus of the present invention.
Figure 14:
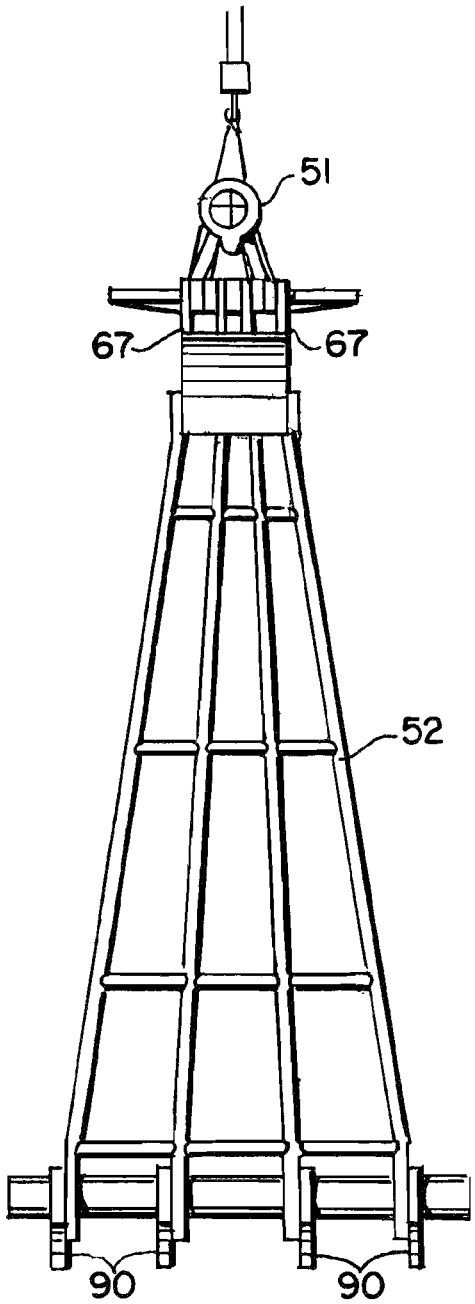
FIG. 14 is a partial elevation view taken along the lines of 14-14 of FIG. 13, showing an alternate arrangement for a lifting implement or grab of the apparatus of the present invention.
Figure 15:
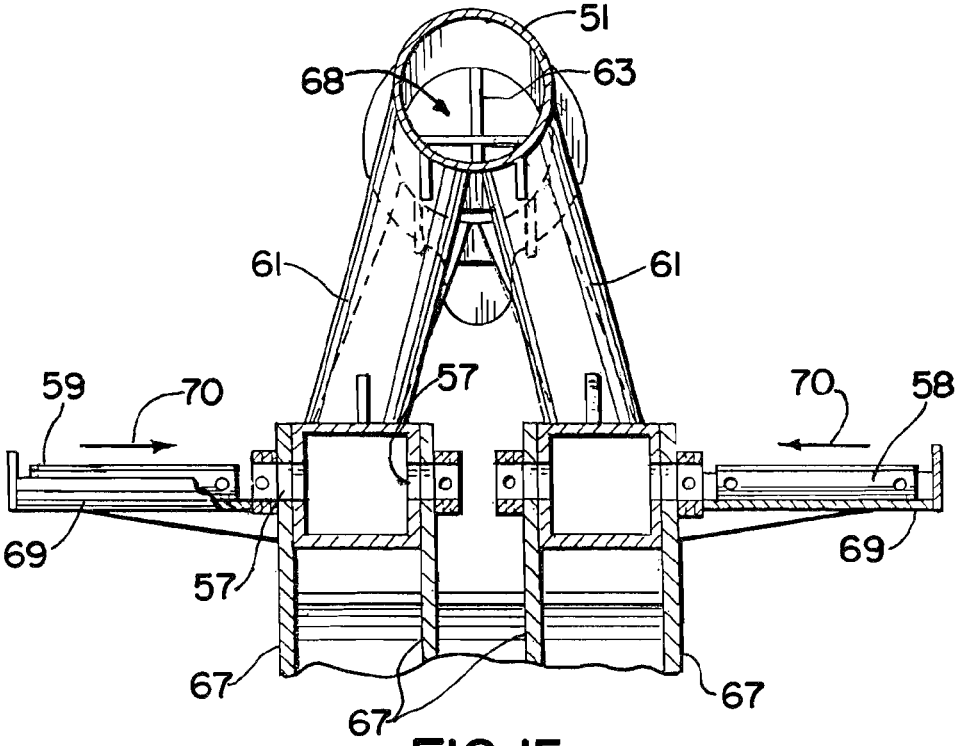
FIG. 15 is a partial elevation view taken along the lines of 15-15 of FIG. 13, showing the plates and pivotal connections of an alternate arrangement for a lifting implement or grab of the apparatus of the present invention, in a non-operating position.

FIGS. 10-16 show an alternate arrangement for a lifting implement or grab designated generally by the numeral 50 in FIG. 13. The lifting implement or grab 50 would be used in combination with the vessels or hulls 11, 12 of the preferred embodiment as well as the frames 13, 14 and other rigging and fittings that were discussed with respect to the preferred embodiment of FIGS. 1-9. In FIGS. 10-16, the truss or frame 51 replaces the beam 25. Truss or frame 51 thus supports a pair of truss sections or jaws 52, 53. Each jaw 52, 53 can have teeth 90. A pivot connects each truss section or jaw 52, 53 to the truss or frame 51 as shown in FIGS. 13, 14, 15, 16. Pivot 65 connects truss section or jaw 52 to truss or frame 51. Similarly, pivot 66 joins truss section or jaw 53 to truss or frame 51. Plates 67 can be provided at the upper end portion of each jaw/truss section 52, 53 for reinforcing each jaw 52, 53 at pivotal/pinned connections 58, 59 (see FIGS. 13, 15-16).

Figure 10:
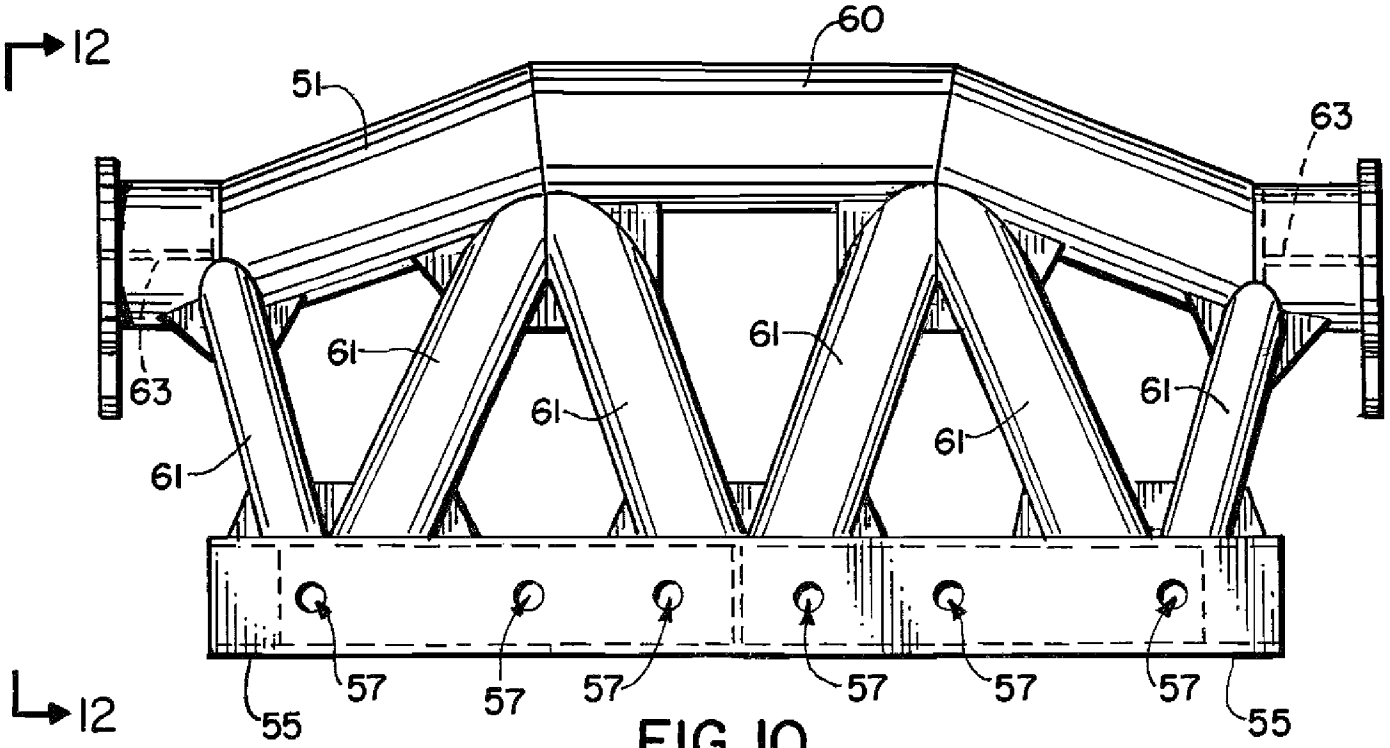
FIG. 10 is a partial perspective view showing the truss or frame in an alternate arrangement for a lifting implement or grab of the apparatus of the present invention.
Figure 12:
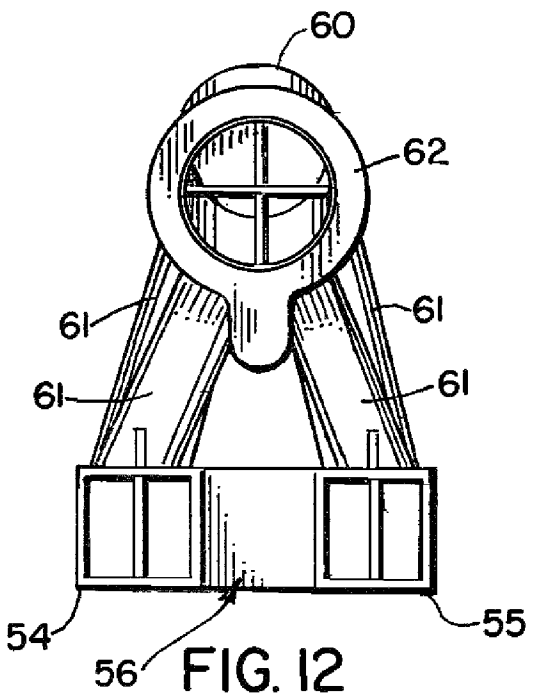
FIG. 12 is a partial side view showing the truss or frame of an alternate arrangement for a lifting implement or grab of the present invention, taken along the lines 12-12 of FIG. 10.
Figure 11:
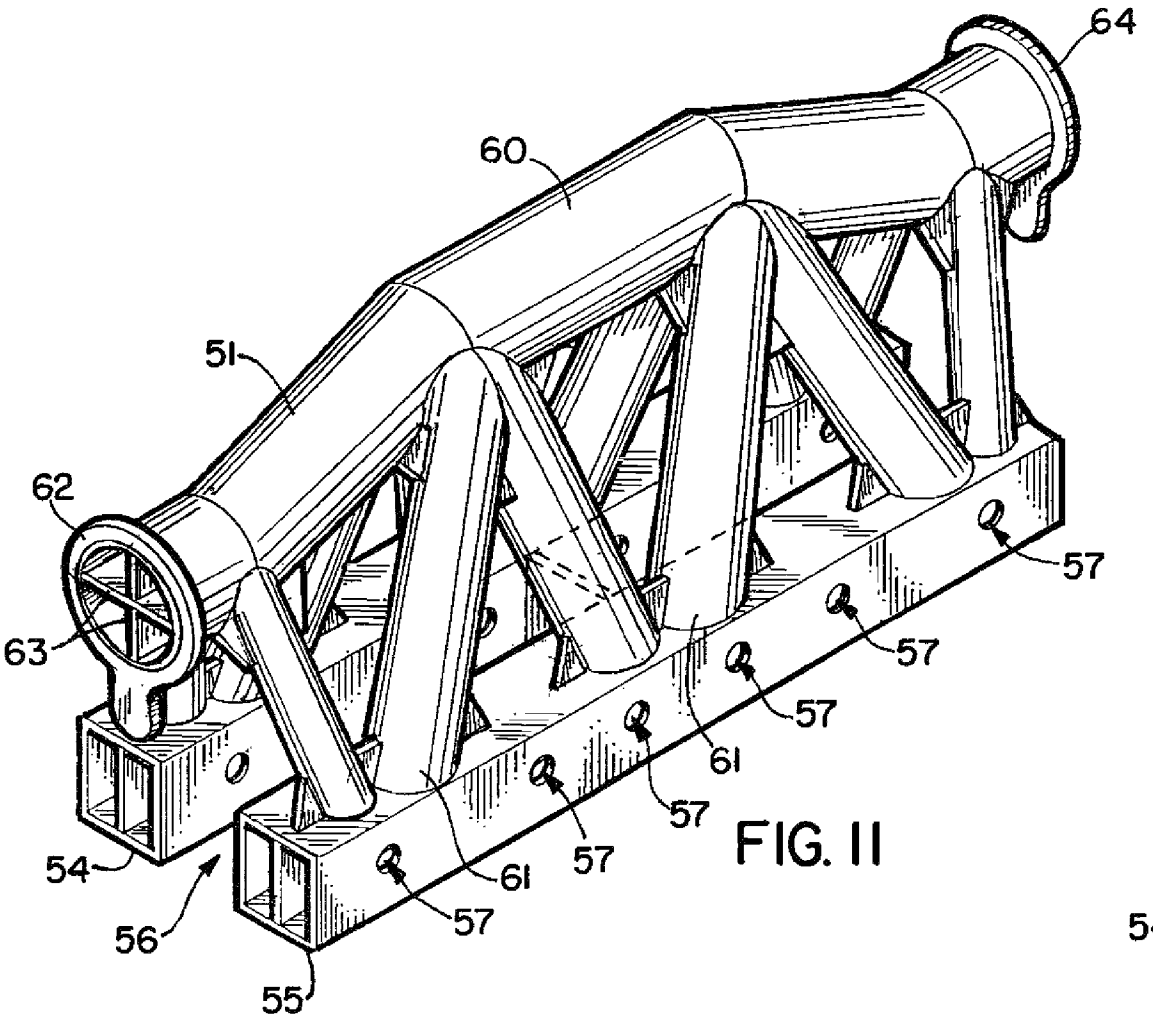
FIG. 11 is a partial perspective view showing the truss or frame in an alternate arrangement for a lifting implement or grab of the apparatus of the present invention.

FIGS. 10-12 and 15-16 show truss or frame 51 in more detail. Truss or frame 51 provides an upper arched member 60. A pair of spaced apart beams 54, 55 are supported below the upper arched member 60 by a plurality of braces 61 which can be diagonally extending braces as shown in FIGS. 10 and 11. A space or gap 56 is provided in between the beams 54, 55 as shown in FIG. 11.

Each beam 54, 55 provides adjustment openings 57. These adjustment openings 57 are provided so that the position of the pivots 65, 66 can be adjusted. The locations of the pivots 65, 66 can be adjusted either closer together or farther apart as desired. In FIG. 13, the innermost adjustment openings 57 are empty as are the outermost adjustment openings 57. The truss sections or jaws 52, 53 are connected to adjustment openings 57 that are in between the innermost and outermost adjustment openings as shown in FIG. 13.

All of the adjustment openings can be seen in FIGS. 10 and 11 because neither of the truss sections or jaws 52, 53 are connected to the truss or frame 51 in FIGS. 10 and 11. In FIG. 13, there can be seen a plurality of plates 67 at the upper end portion of a truss section or jaw 52, 53. Each plate 67 has a plate opening through which can be inserted a pin or pin connector or pinned connection 58 or 59. The two most inner plates 67 fit in the gap or space 56 that is in between the beams 54, 55 (see FIGS. 15-16). These pinned connections 58, 59 can be seen in FIGS. 15, 16 wherein the pinned connections 58, 59 have been perfected with an adjustment opening 57 as shown.

Annular flanges or rings 62, 64 are provided at the end portions of the upper arched member 60 as shown in FIG. 11. The upper arched member 60 can be hollow, providing bore 68. Arched member 60 can be reinforced internally (i.e., in bore 68) with cross bracing 63 (see FIG. 11). The annular flanges or rings 62, 64 enable a lifting line 32 to be wrapped around the upper arched member 60, the ring 62, 64 preventing removal of the lifting line 32 from the upper arched member 60 in a lateral direction (see FIG. 13). The annular flanges or rings 62, 64 thus function as retainers to prevent a separation of the lifting lines 32 from a position wherein they are wrapped around or under the upper arched member 60 as shown in FIGS. 11 and 13.

Figure 16:
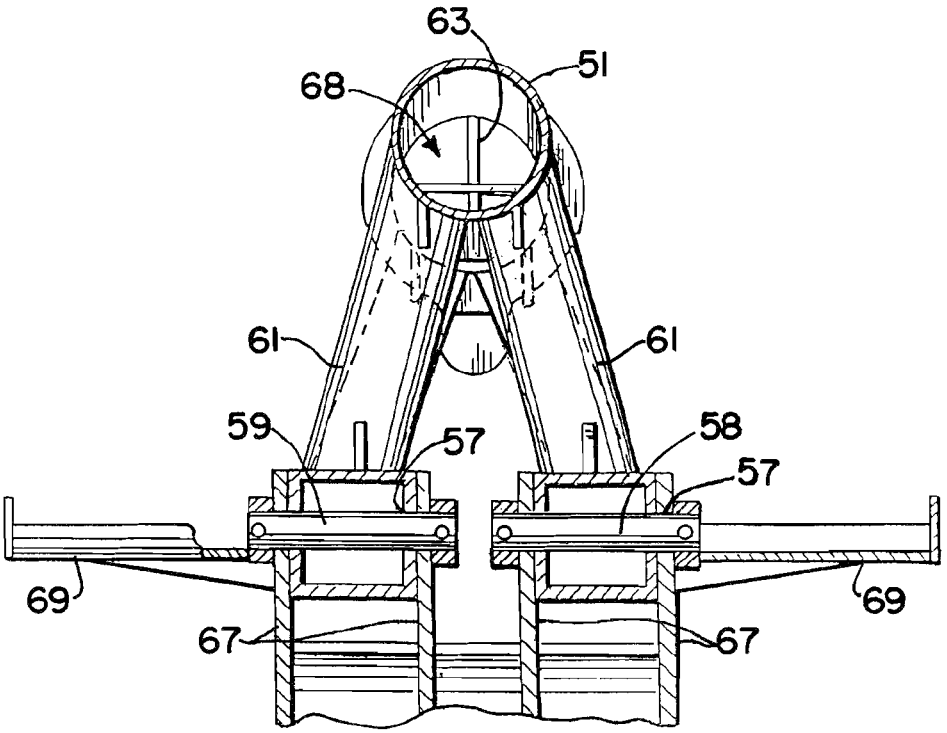
FIG. 16 is a partial elevation view taken along the lines of 15-15 of FIG. 13, showing the plates and pivotal connections of an alternate arrangement for a lifting implement or grab of the apparatus of the present invention, in an operating position.

Pins/pinned connections 58, 59 can provide pins that slide in trays 69 (see arrows 70, FIG. 15) so that the pins are able to slide into the operating position of FIG. 16.

The following is a list of parts and materials suitable for use in the present invention.

PARTS LIST

| Part Number | Description |
|---|---|
| 10 | marine lifting apparatus |
| 11 | vessel/hulls |
| 12 | vessel/hulls |
| 13 | first frame or truss |
| 14 | second frame or truss |
| 15 | universal joint |
| 16 | hinge or pinned connection |
| 17 | universal joint |

-continued

PARTS LIST

| Part Number | Description |
|---|---|
| 18 | lifting implement/grab |
| 19 | load spreader platform/interface |
| 20 | load spreader platform/interface |
| 21 | lifting area |
| 22 | truss section/jaw |
| 23 | truss section/jaw |
| 24 | water surface |
| 25 | beam |
| 26 | pinned connection |
| 27 | pinned connection |
| 28 | lift line |
| 29 | lift line |
| 30 | hull deck |
| 31 | winch |
| 32 | lift line |
| 33 | sheave |
| 34 | lift line |
| 35 | sheave |
| 36 | winch |
| 37 | sheave |
| 38 | sheave |
| 39 | transverse line |
| 40 | transverse line |
| 41 | padeye |
| 42 | tapered section/blade |
| 43 | tapered section/blade |
| 44 | package |
| 45 | seabed |
| 46 | lift line |
| 47 | vessel/barge/floating transport |
| 48 | sheave |
| 49 | winch |
| 50 | lifting implement/grab |
| 51 | truss/frame |
| 52 | truss section/jaw |
| 53 | truss section/jaw |
| 54 | beam |
| 55 | beam |
| 56 | space/gap |
| 57 | opening |
| 58 | pin/pinned connection/pivotal connection |
| 59 | pin/pinned connection/pivotal connection |
| 60 | upper arched member |
| 61 | brace |
| 62 | annular flange/ring |
| 63 | cross bracing |
| 64 | annular flange/ring |
| 65 | pivot |
| 66 | pivot |
| 67 | plates |
| 68 | bore |
| 69 | tray |
| 70 | arrow |
| 90 | teeth |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A marine lifting apparatus comprising:

a) one or more marine vessel buoyant hulls;

b) the hulls supporting one or more frames, each of said one or more frames having frame rigging that includes first and second upper cables, first and second lower cables and one or more transverse lines;

c) a grab that can be lifted and lowered by a selected one of said frame or frames and said first and second upper cables of the frame rigging, the grab including a beam having beam spaced end portions, first and second trussed sections, each trussed section connected to one of said beam end portions with a hinged connection, each trussed section extending below said transverse lines;

d) adjustment positions on the beam that enable the distances between the hinged connections to be changed; and e) wherein the first and second upper cables each connect between said one or more frames and the beam;

f) wherein each trussed section extends below the beam;

g) wherein each of said first and second lower cables connects one said frame to one said trussed section below said beam; and h) wherein each of said transverse lines connects one said trussed section to the other said trussed section below the said beam.

2. The marine lifting apparatus of claim 1 wherein each of said frames is generally triangular in shape.

3. The marine lifting apparatus of claim 1 wherein each of said frames is a truss.

4. The marine lifting apparatus of claim 1 wherein said one or more frames comprises multiple frames.

5. The marine lifting apparatus of claim 1 wherein said one or more marine vessel buoyant hulls comprises multiple buoyant hulls.

6. The marine lifting apparatus of claim 5 wherein each of said buoyant hulls is a barge.

7. The marine lifting apparatus of claim 1 wherein the hinged connection is a pinned connection.

8. The marine lifting apparatus of claim 1 wherein a first of said frames is much wider at one end portion than at its other end portion.

9. The marine lifting apparatus of claim 1 wherein a second of said frames is much wider at one end portion than at its other end portion.

10. The marine lifting apparatus of claim 1 wherein each of said frames has end portions, one end portion being wider than the other at a position where the frame connects to a barge.

11. The marine lifting apparatus of claim 1 wherein each of said frames is generally arch shaped.

12. A marine lifting apparatus comprising:

a) one or more marine vessel buoyant hulls;

b) the hulls supporting one or more frames, each of said frames having frame rigging that includes first and second upper cables, and first and second lower cables, and one or more transverse lines;

c) a grab that can be lifted and lowered by said one or more frames and said first and second upper cables of said frame rigging, the grab including a beam having beam spaced end portions, first and second trussed sections, each trussed section having an upper truss end and a lower truss end, each said trussed section connected to one of said beam end portions with a hinged connection, and each trussed section extending below said transverse lines;

d) wherein said first and second upper cables of said rigging spans between said one or more frames and said beam, wherein each said first and second upper cable extends to one said frame above said beam;

e) wherein said lower cables connect to said one or more frames and to said trussed sections and not to the beam;

f) wherein each said trussed section includes a transversely wider portion in between the upper truss end and the lower truss end; and g) wherein each of said transverse lines extend laterally to connect one said trussed section to the other said trussed section at said wider portion and below said beam.

13. The marine lifting apparatus of claim 12 wherein each of said frames is generally triangular in shape.

14. The marine lifting apparatus of claim 12 wherein each of said frames is a truss.

15. The marine lifting apparatus of claim 12 wherein said one or more frames comprises multiple frames.

16. The marine lifting apparatus of claim 12 wherein said one or more marine vessel buoyant hulls comprises multiple buoyant hulls.

17. The marine lifting apparatus of claim 12 wherein the hinged connection is a pinned connection.

18. The marine lifting apparatus of claim 12 wherein a first of said frames is much wider at one end portion than at its other end portion.

19. The marine lifting apparatus of claim 12 wherein a second of said frames is much wider at one end portion than at its other end portion.

20. The marine lifting apparatus of claim 12 wherein each of said frames has end portions, one end portion being wider than the other at a position where the frame connects to a barge.

21. The marine lifting apparatus of claim 12 wherein each of said frames is generally arch shaped.

22. A marine lifting apparatus comprising:

a) one or more marine vessel buoyant hulls;

b) the hulls supporting one or more frames, at least one of said frames having frame rigging;

c) a grab that can be lifted and lowered by the frame and the frame rigging, the grab including a beam having beam spaced end portions, first and second trussed sections, each said trussed section having an upper truss end and a lower truss end, each said trussed section connected to one of said beam end portions with a hinged connection;

d) wherein frame rigging includes first and second vertical lift lines that span between said at least one of the frames and the beam, and wherein said frame rigging includes first and second lower cables;

e) wherein each trussed section is below said hinged connection;

f) wherein each of said first and second lower cables connects one said frame to one said trussed section below said hinged connection; and g) wherein each trussed section extends below said first and second lower cables.

23. The marine lifting apparatus of claim 22 wherein each of said frames is generally triangular in shape.

24. The marine lifting apparatus of claim 22 wherein each of said frames is a truss.

25. The marine lifting apparatus of claim 22 wherein said one or more frames comprises multiple frames.

26. The marine lifting apparatus of claim 22 wherein said one or more marine vessel buoyant hulls comprises multiple buoyant hulls.

27. The marine lifting apparatus of claim 22 wherein the hinged connection is a pinned connection.

28. The marine lifting apparatus of claim 22 wherein a first of said frames is much wider at one end portion than at its other end portion.

29. The marine lifting apparatus of claim 22 wherein a second of said frames is much wider at one end portion than at its other end portion.

30. The marine lifting apparatus of claim 22 wherein each of said frames has end portions, one end portion being wider than the other at a position where the frame connects to a barge.

31. The marine lifting apparatus of claim 22 wherein each of said frames is generally arch shaped.

* * * * *